United States Patent [19]

Knülle et al.

[11] 4,168,744

[45] Sep. 25, 1979

[54] OVAL HEADER HEAT EXCHANGER

[75] Inventors: Helmut Knülle, Kassel; Harald Pieschke, Zierenberg, both of Fed. Rep. of Germany

[73] Assignee: Schmidt'sche Heissdampf-GmbH, Kassel-Bettenhausen, Fed. Rep. of Germany

[21] Appl. No.: 809,067

[22] Filed: Jun. 22, 1977

Related U.S. Application Data

[62] Division of Ser. No. 647,170, Jan. 7, 1976, Pat. No. 4,130,398.

[30] Foreign Application Priority Data

Jan. 10, 1975 [DE] Fed. Rep. of Germany ..... 2500827

[51] Int. Cl.[2] ..... F28D 7/10; F28F 9/18

[52] U.S. Cl. ..... 165/154; 165/142; 165/174; 165/175; 165/178

[58] Field of Search ..... 165/142, 164, 173, 174, 165/175, 176, 178, 154

[56] References Cited

U.S. PATENT DOCUMENTS

| | | | |
|---|---|---|---|
| 1,699,688 | 1/1929 | Cross | 122/DIG. 13 |
| 1,895,947 | 1/1933 | Unger | 165/175 |
| 3,392,779 | 7/1968 | Tilbrook | 165/175 |

FOREIGN PATENT DOCUMENTS

| | | | |
|---|---|---|---|
| 447300 | 7/1927 | Fed. Rep. of Germany | 165/178 |
| 740769 | 9/1943 | Fed. Rep. of Germany | 165/175 |
| 2224899 | 12/1972 | Fed. Rep. of Germany | 165/154 |
| 77157 | 8/1918 | Switzerland | 122/DIG. 16 |
| 209828 | 1/1924 | United Kingdom | 165/173 |
| 1199342 | 7/1970 | United Kingdom | 165/173 |

OTHER PUBLICATIONS

"Use of Waste-Heat Boilers and Some Structural Features", Mitteilungen der Ugb 49, vol. 3, Jun. 1969, pp. 166 and 167, D. Capitaine, P. H. Stoffels and W. Jentzach.

*Primary Examiner*—Sheldon Jay Richter
*Attorney, Agent, or Firm*—Wenderoth, Lind & Ponack

[57] ABSTRACT

A heat exchanger includes banks of double-pipe elements connected to oval headers, the opposite ends of which are connected by round transition elements to main headers. Each oval header and the respective transition elements are formed from a single, integral member, initially a cylindrical pipe, without connecting welds. The outer ends of the transition elements are reduced to form nipple elements for attachment to the main headers. The nipple elements have a greater wall thickness than the transition elements.

1 Claim, 4 Drawing Figures

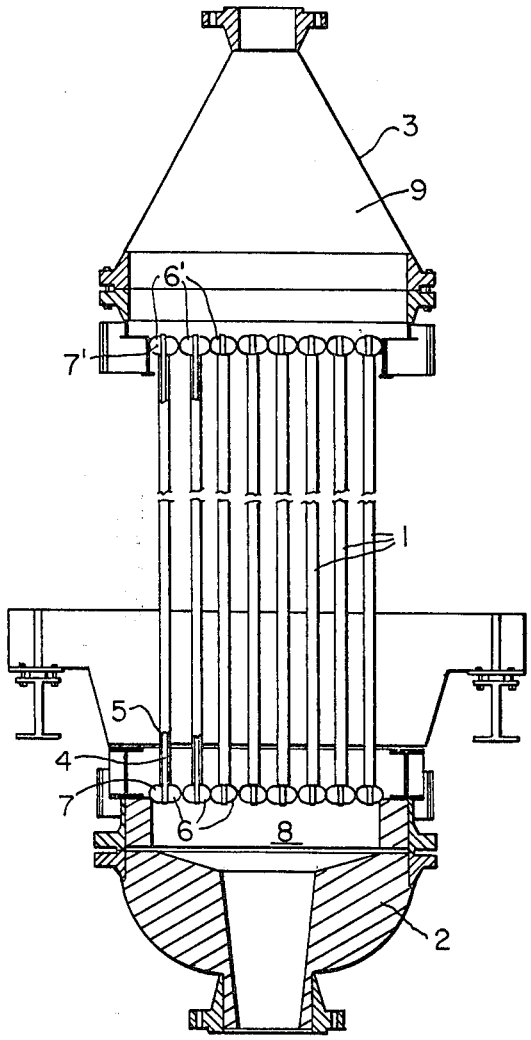
FIG. 1
FIG. 3
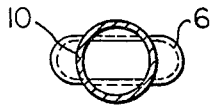
FIG. 4
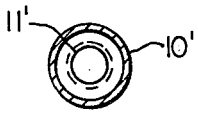
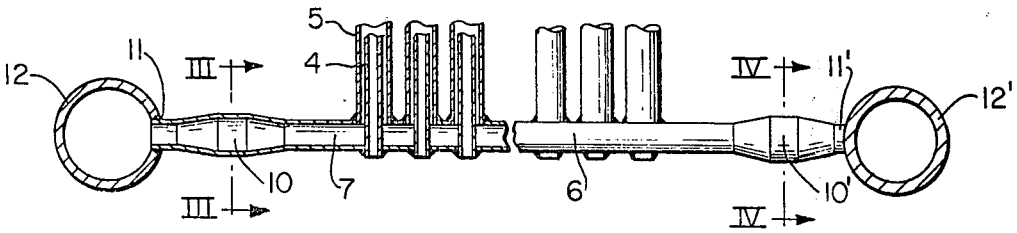
FIG. 2

OVAL HEADER HEAT EXCHANGER

This is a division of application Ser. No. 647,170 filed Jan. 7, 1976, now U.S. Pat. No. 4,130,398.

BACKGROUND OF THE INVENTION

The invention relates to a heat exchanger of the type including banks or registers of double-pipe elements attached at opposite ends thereof to oval headers which are provided bilaterally with transition elements welded to main headers and forming a transition from the oval cross section to a round cross section.

Heat exchangers of this type are employed for the rapid cooling of hot process gases, high-pressure steam being simultaneously produced. The essential elements of such heat exchangers are the double pipes comprising concentrically arranged inner and outer pipes and the oval headers welded to the pipe ends. In this manner there are formed banks or registers of pipe elements that are arranged in parallel to one another and joined to the main headers of the heat exchanger.

As is well known, the hot process gases flow through the inner pipes of the banks, while the cooling water flows through the annular gap between the inner and outer pipes. The oval headers feed the cooling water to one end of the pipe element. At the other end of the pipe element, the oval headers lead the resultant produced mixture of steam and water off to the main headers.

The double-pipe arrangement provides the advantage that all pressure-leading components can be made to have a low wall thickness even for use with high steam pressures. Thus, local excessive thermal stresses will not be formed in the system. The differences in expansion between the heated inner pipes and the outer pipes subjected to the temperature of saturated steam are compensated due to the high elasticity of the arrangement.

The oval headers as such are welded together in a gas tight manner in the longitudinal direction, so as to form components comparable to tube plates having a low wall thickness even at high pressures.

The oval headers are produced from deformation of round pipes and are provided with transition elements that form the transition from the oval cross section to a round cross section, so as to permit welding of the oval headers to the main headers. Under the deformation processes hitherto employed for the manufacture of the oval headers, i.e. such as warm rolling on dual rolls in the form of shape rolls or cold rolling on a bending roll, it was necessary to make the transition elements as separate components that were then welded to the oval headers. However, such a weld is difficult to achieve due to its shape or form. Accordingly, the manufacture of known oval headers has been very complex and expensive, and includes the substantial danger of leaks formed in the welds.

SUMMARY OF THE INVENTION

Accordingly, the object of the invention is to provide for simplified manufacture of the oval headers while simultaneously increasing their operation reliability and safety.

According to the invention, this object is achieved by manufacturing the oval headers together with the transition elements from a single cylindrical pipe member, without connecting welds therebetween.

This eliminates the welds otherwise situated between the oval header and the two transition elements, and results in a considerable simplification of the manufacture and is simultaneously accompanied by an avoidance of the possibility of leaks.

In order to increase the strength of the connection between the oval headers and the main headers, the pipe ends to be welded to the main headers, i.e. the outer ends of the transition elements, are subjected to a reducing operation to provide nipple-shaped ends having a greater wall thickness than the transition elements.

BRIEF DESCRIPTION OF THE DRAWINGS

An exemplified embodiment of the present invention is explained in more detail in the following detailed description, taken with the accompanying drawings, wherein:

FIG. 1 is a simplified view, partially in longitudinal section, of a heat exchanger including double-pipe banks and oval headers in accordance with the invention;

FIG. 2 is an enlarged view, partially in section, of a gas inlet side oval header of the heat exchanger of FIG. 1, as viewed from a side thereof;

FIG. 3 is a cross section through the oval header taken along the line III—III of FIG. 2; and FIG. 4 is a cross section through the oval header taken along the line IV—IV of FIG. 2.

DETAILED DESCRIPTION OF THE INVENTION

The heat exchanger shown in FIG. 1 includes a number of double-pipe elements 1 that are arranged in banks and that extend between a gas inlet head 2 and a gas outlet head 3.

Each double-pipe element consists of an outer pipe 5 and an inner pipe 4 arranged coaxially thereto. The opposite ends of pipes 4 and 5 are joined by oval headers 6 and 6'.

Outer pipes 5 open into an interior 7 or 7' of oval headers 6 or 6'. Inner pipes 4 pass through oval headers 6 or 6' and open into an interior 8 of gas inlet head 2 and in an interior 9 of gas outlet head 3.

Oval headers 6 and 6' are each made according to the invention from a cylindrical piece of pipe, but which is deformed to have an oval cross section along a portion of the pipe length to be joined to elements 1. The deformation of the round pipe cross section to the oval cross section may be achieved by known metal working processes and tools. However, the deformation of the pipe does not include the two pipe ends. This produces a member having partly cylindrical transition elements 10 and 10' at opposite ends of the oval length, which elements provide a transition from the oval cross section to the round cross section of the pipe.

In a particularly preferred embodiment, the ends 11 and 11' of elements 10 and 10' are reduced by a known metal working operation to have a thicker wall size than elements 10 and 10'. This provides reinforcement of those portions of the oval headers which are welded to main headers 12 and 12'.

In principle, the nipples formed by reduced ends 11 and 11' of transition elements 10 and 10' may be of the same wall thickness as elements 10 and 10'. However, such an arrangement would require that main headers be of a thicker and/or stronger construction.

It will be apparent that various modifications may be made to the above specifically described arrangement without departing from the scope of the invention.

What is claimed is:

1. A heat exchanger comprising:

a plurality of oval header and transition elements, each said element comprising an integral elongated member formed of a single length of pipe, said member having a portion intermediate the ends thereof deformed into an oval shape to form an oval header, said ends having a round cross-section and forming transition elements, and the outer end portions of said transition elements being deformed to have a reduced diameter and a greater thickness than the remainder of said transition elements, thus forming reduced diameter, increased thickness cylindrical nipple elements;

said oval headers being welded side-by-side to form first and second pressure tight tube sheets;

a gas inlet head connected to a first side of said first tube sheet;

a gas outlet head connected to a first side of said second tube sheet;

a plurality of coaxial double-pipe elements, each including an inner pipe and an outer pipe, each said double-pipe element having the opposite ends thereof attached by welding to respective of said oval headers at second sides of said first and second tube sheets such that said outer pipe opens at opposite ends thereof into said respective oval headers and said inner pipe extends through said respective oval headers and opens at opposite ends thereof into said gas inlet head and said gas outlet head; and a plurality of main headers, said nipple elements of each of said oval header and transition elements being directly attached by welding to walls of respective of said main headers.

* * * * *